US010066646B2

(12) United States Patent
Ogawa

(10) Patent No.: US 10,066,646 B2
(45) Date of Patent: Sep. 4, 2018

(54) ACTUATOR UNIT

(71) Applicant: KAYABA INDUSTRY CO., LTD., Tokyo (JP)

(72) Inventor: Takayuki Ogawa, Kanagawa (JP)

(73) Assignee: KYB Corporation, Tokyo (JP)

( * ) Notice: Subject to any disclaimer, the term of this patent is extended or adjusted under 35 U.S.C. 154(b) by 188 days.

(21) Appl. No.: 14/764,940

(22) PCT Filed: Jan. 15, 2014

(86) PCT No.: PCT/JP2014/050506

§ 371 (c)(1),
(2) Date: Jul. 30, 2015

(87) PCT Pub. No.: WO2014/125854

PCT Pub. Date: Aug. 21, 2014

(65) Prior Publication Data

US 2015/0354606 A1 Dec. 10, 2015

(30) Foreign Application Priority Data

Feb. 15, 2013 (JP) ..... 2013-027243

(51) Int. Cl.
*F15B 11/12* (2006.01)
*F15B 11/10* (2006.01)
*B61F 5/24* (2006.01)

(52) U.S. Cl.
CPC ..... *F15B 11/10* (2013.01); *B61F 5/245* (2013.01); *F15B 11/121* (2013.01);
(Continued)

(58) Field of Classification Search
CPC ..... F15B 2211/30565; F15B 11/121; F15B 2211/7653
(Continued)

(56) References Cited

U.S. PATENT DOCUMENTS 2,261,444 A * 11/1941 Neubert, Jr. ..... B63H 25/28 114/150
2,895,455 A * 7/1959 Clowes ..... B60H 1/00442 91/357
(Continued)

FOREIGN PATENT DOCUMENTS

DE 102010011912 A1 * 9/2011 ..... B60G 17/08
JP S50-14985 A 2/1975
(Continued)

*Primary Examiner* — F. Daniel Lopez
*Assistant Examiner* — Matthew Wiblin
(74) *Attorney, Agent, or Firm* — Rabin & Berdo, P.C.

(57) ABSTRACT

An actuator unit includes a rod side chamber and a piston side chamber defined in the cylinder by a piston; a tank; a direction control valve configured to allow a working fluid discharged from the pump to be supplied selectively to the rod side chamber and the piston side chamber; a first control passage that communicates the rod side chamber with the tank; a second control passage that communicates the piston side chamber with the tank; a first variable relief valve provided on the first control passage, the first variable relief valve being configured to have a varied valve opening pressure; a second variable relief valve provided on the second control passage, the second variable relief valve configured to have a varied valve opening pressure; and a center passage that communicates the tank with the interior of the cylinder.

3 Claims, 3 Drawing Sheets

(52) U.S. Cl.
CPC ..... *F15B 2211/30505* (2013.01); *F15B 2211/30565* (2013.01); *F15B 2211/50518* (2013.01); *F15B 2211/8613* (2013.01); *F15B 2211/8616* (2013.01)

(58) Field of Classification Search
USPC ..... 91/357, 402, 455
See application file for complete search history.

(56) References Cited

U.S. PATENT DOCUMENTS

| | | | | | |
|---|---|---|---|---|---|
| 2,898,890 | A | | 8/1959 | Lynott | |
| 2,954,755 | A | * | 10/1960 | Pecchenino | F15B 11/121 91/357 |
| 3,253,515 | A | * | 5/1966 | Wilkinson | F15B 21/041 91/401 |
| 3,470,792 | A | | 10/1969 | Darling | |
| 4,308,018 | A | * | 12/1981 | Nakamura | B63H 20/10 440/61 G |
| 5,217,245 | A | * | 6/1993 | Guy | B60G 21/0556 280/124.152 |
| 5,960,695 | A | * | 10/1999 | Aardema | F15B 11/006 137/596.17 |
| 7,219,592 | B2 | * | 5/2007 | Nielsen | F15B 11/024 91/437 |
| 7,690,196 | B2 | * | 4/2010 | Nielsen | F15B 11/003 60/444 |
| 2011/0192157 | A1 | * | 8/2011 | Ogawa | B61F 5/245 60/469 |

FOREIGN PATENT DOCUMENTS

| | | | |
|---|---|---|---|
| JP | S55-58474 | U | 4/1980 |
| JP | S58-157508 | U | 10/1983 |
| JP | 2009-160956 | A | 7/2009 |
| JP | 2010-065797 | A | 3/2010 |

* cited by examiner

ACTUATOR UNIT

TECHNICAL FIELD

The present invention relates to an actuator unit.

BACKGROUND ART

An actuator unit is used in a railway vehicle, for example, by being interposed between a vehicle body and a truck in order to suppress left-right direction vibration relative to an advancing direction of the vehicle body.

JP2010-65797A discloses an actuator unit including: a cylinder; a piston slidably inserted into the cylinder; a rod inserted into the cylinder and coupled to the piston; a rod side chamber and a piston side chamber defined within the cylinder by the piston; a tank; a first opening/closing valve provided on midway of a first passage that communicates the rod side chamber with the piston side chamber; a second opening/closing valve provided on midway of a second passage that communicates the piston side chamber with the tank; a pump that is configured to supply a working fluid to the rod side chamber; a motor that is configured to drive the pump; an exhaust passage that communicates the rod side chamber to the tank; and a variable relief valve provided on midway of the exhaust passage.

According to this actuator unit, a direction of thrust output thereby is determined by opening and closing the first opening/closing valve and the second opening/closing valve appropriately. By rotating the pump at a fixed speed using the motor, a constant flow is supplied into the cylinder, and meanwhile, by adjusting a relief pressure of the variable relief valve, a pressure in the cylinder is controlled. As a result, the actuator unit described above can output thrust of a desired magnitude in a desired direction.

SUMMARY OF INVENTION

When lateral direction vibration of a vehicle body of a railway vehicle is suppressed using the actuator unit disclosed in JP2010-65797A, the vibration of the vehicle body can be suppressed by detecting a lateral direction acceleration of the vehicle body using an acceleration sensor and outputting thrust that countervails the detected acceleration from the actuator unit. In this case, when the railway vehicle travels in a curved section, for example, stable acceleration acts on the vehicle body, and therefore the thrust output by the actuator unit may become extremely large due to effects from noise and drift input into the acceleration sensor.

The vehicle body of the railway vehicle is supported by a truck using an air spring or the like. In a bolsterless truck in particular, when the vehicle body swings in the lateral direction relative to the bogie, the air spring generates a reaction force for returning the vehicle body to the center.

When the railway vehicle travels in a curved section such that the vehicle body swings relative to the truck, and the actuator unit generates a large thrust in a direction for returning the vehicle body to a neutral position due to the effects of noise and drift, the air spring generates a reaction force in an identical direction. Hence, the force for returning the vehicle body to the neutral position becomes excessive such that the vehicle body passes the neutral position and displaces to an opposite side, and as a result, it may be difficult to converge the vibration of the vehicle body.

An object of the present invention is to provide an actuator unit that is capable of suppressing vibration of a vibration damping subject with stability.

According to one aspect of the present invention, an actuator unit includes a cylinder; a piston slidably inserted into the cylinder, the piston defining a rod side chamber and a piston side chamber in the cylinder; a rod inserted into the cylinder and coupled to the piston; a tank; a pump; a direction control valve configured to allow a working fluid discharged from the pump to be supplied selectively to the rod side chamber and the piston side chamber; a first control passage that communicates the rod side chamber with the tank; a second control passage that communicates the piston side chamber with the tank; a first variable relief valve provided on the first control passage, the first variable relief valve being configured to have a varied valve opening pressure; a second variable relief valve provided on the second control passage, the second variable relief valve configured to have a varied valve opening pressure; and a center passage that communicates the tank with the interior of the cylinder. The first variable relief valve opens when a pressure in the rod side chamber reaches the valve opening pressure so as to allow the working fluid to flow from the rod side chamber toward the tank. The second variable relief valve opens when a pressure in the piston side chamber reaches the valve opening pressure so as to allow the working fluid to flow from the piston side chamber toward the tank.

DESCRIPTION OF EMBODIMENTS

Figure 1:
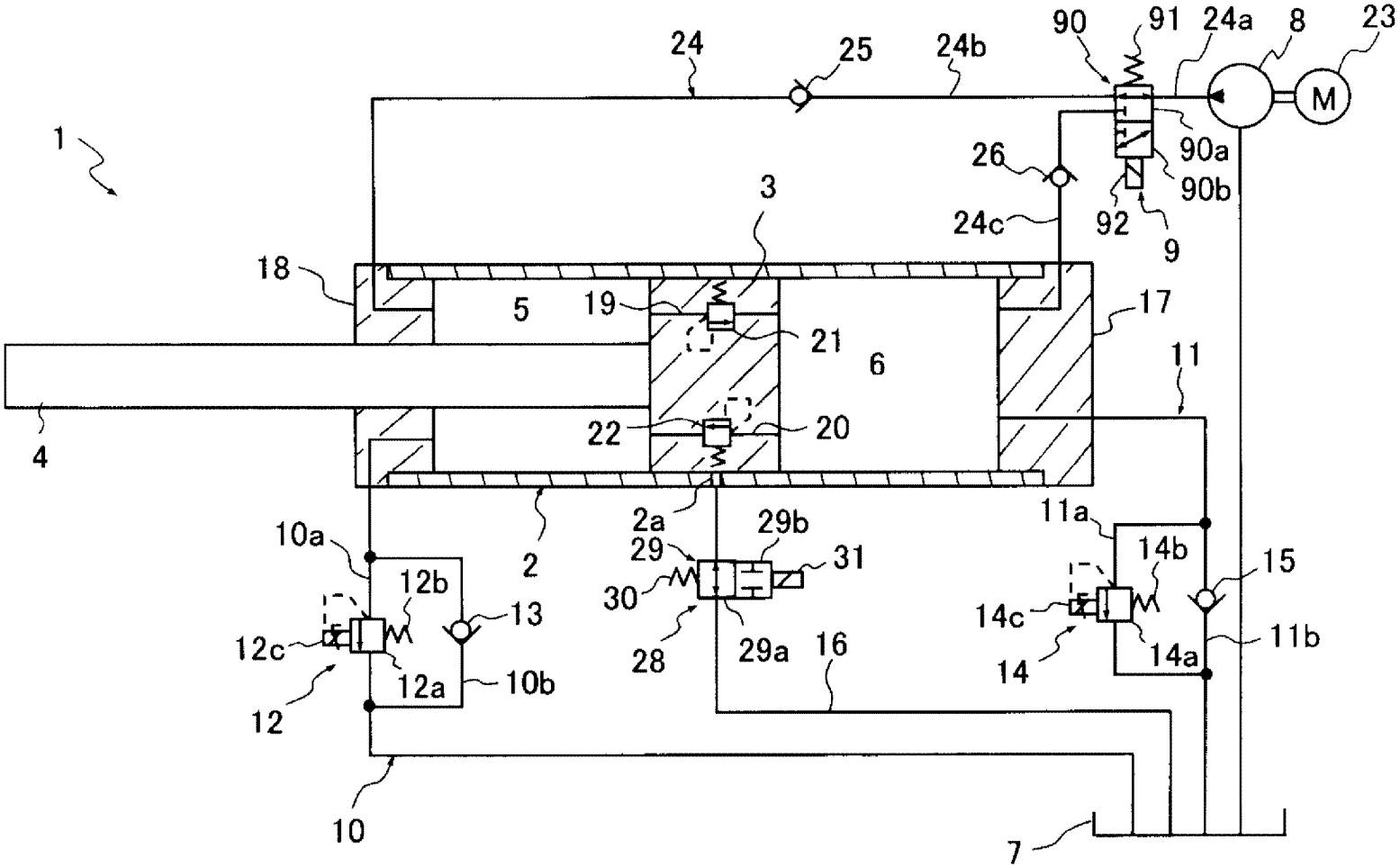
FIG. 1 is a schematic view of an actuator unit according to an embodiment of the present invention.

An embodiment of the present invention will be described below with reference to the attached figures. As shown in FIG. 1, an actuator unit 1 according to this embodiment of the present invention includes: a cylinder 2; a piston 3 slidably inserted into the cylinder 2, the piston 3 defining a rod side chamber 5 and a piston side chamber 6 within the cylinder 2; a rod 4 inserted into the cylinder 2 and coupled to the piston 3; a tank 7; a pump 8; a direction control valve 9 configured to allow a working fluid discharged from the pump 8 to be supplied selectively to the rod side chamber 5 and the piston side chamber 6; a first control passage 10 that communicates the rod side chamber 5 with the tank 7; a second control passage 11 communicates the piston side chamber 6 to the tank 7; a first variable relief valve 12 provided on midway of the first control passage 10, the first variable relief valve 12 being configured to have a varied valve opening pressure; a second variable relief valve 14 provided on midway of the second control passage 11, the second variable relief valve 14 being configured to have a varied valve opening pressure; and a center passage 16 communicates the tank 7 with the interior of the cylinder 2. The first variable relief valve 12 opens when a pressure in the rod side chamber 5 reaches the valve opening pressure so as to allow the working fluid to flow from the rod side chamber 5 toward the tank 7. The second variable relief valve 14 opens when a pressure in the piston side chamber 6 reaches the valve opening pressure so as to allow the working fluid to flow from the piston side chamber 6 toward the tank 7. Working oil is charged into the rod side chamber 5 and the piston side chamber 6 as the working fluid. A gas is charged into the tank 7 in addition to the working oil. There is no need to set the tank 7 in a pressurized condition by charging the gas in a compressed condition. However, the tank 7 may be pressurized. The working fluid may be a fluid other than working oil, and may also be a gas.

To cause the actuator unit 1 to expand, the pump 8 is driven such that the working oil discharged from the pump 8 is supplied to the piston side chamber 6 by the direction control valve 9. By adjusting the valve opening pressure of the first variable relief valve 12 and the valve opening pressure of the second variable relief valve 14, a force obtained by multiplying a surface area (a piston side pressure receiving surface area) of the piston 3 facing the piston side chamber 6 by the pressure in the piston side chamber 6 is increased beyond a resultant force of a force obtained by multiplying a surface area (a rod side pressure receiving surface area) of the piston 3 facing the rod side chamber 5 by the pressure in the rod side chamber 5 and a force obtained by multiplying a pressure acting on the rod 4 from the exterior of the actuator unit 1 by a sectional area of the rod 4, and as a result, the actuator unit 1 generates expansion direction thrust corresponding to a differential pressure between the rod side chamber 5 and the piston side chamber 6. Conversely, to cause the actuator unit 1 to contract, the pump 8 is driven such that the working oil discharged from the pump 8 is supplied to the rod side chamber 5 by the direction control valve 9. By adjusting the valve opening pressure of the first variable relief valve 12 and the valve opening pressure of the second variable relief valve 14, the force obtained by multiplying the piston side pressure receiving surface area by the pressure in the piston side chamber 6 is increased beyond the resultant force of the force obtained by multiplying the rod side pressure receiving surface area by the pressure in the rod side chamber 5 and the force obtained by multiplying the pressure acting on the rod 4 from the exterior of the actuator unit 1 by the sectional area of the rod 4, and as a result, the actuator unit 1 generates contraction direction thrust corresponding to the differential pressure between the rod side chamber 5 and the piston side chamber 6.

Respective parts will now be described in detail. The cylinder 2 is formed in a tubular shape, wherein one end portion (a right end in FIG. 1) is closed by a lid 17 and wherein an annular rod guide 18 is attached to another end portion (a left end in FIG. 1). The rod 4 slidably inserted into the cylinder 2 is slidably inserted into the rod guide 18. The rod 4 projects to the exterior of the cylinder 2 at one end, and another end is coupled to the piston 3 slidably inserted into the cylinder 2.

A gap between an outer periphery of the rod 4 and the cylinder 2 is sealed by a seal member, not shown in the figures. As a result, the interior of the cylinder 2 is maintained in an airtight condition. As described above, the working oil is charged into the rod side chamber 5 and the piston side chamber 6 defined within the cylinder 2 by the piston 3.

Attachment portions, not shown in the figures, are provided respectively on a left end, in FIG. 1, of the rod 4 projecting to the exterior of the cylinder 2 and the lid 17 closing the right end of the cylinder 2. The actuator unit 1 is interposed between vibration damping subjects, for example a vehicle body and a truck of a railway vehicle, by the attachment portions. The actuator unit 1 may also be interposed between a building and a foundation fixed to the ground, a beam of an uppermost floor and a beam of a lowermost floor of a building, and so on.

The rod side chamber 5 and the piston side chamber 6 are communicated by an expansion side relief passage 19 and a contraction side relief passage 20 each of which is provided in the piston 3. An expansion side relief valve 21 that opens when the pressure in the rod side chamber 5 exceeds the pressure in the piston side chamber 6 by a predetermined amount, thereby opening the expansion side relief passage 19 such that the pressure in the rod side chamber 5 escapes into the piston side chamber 6, is provided on midway of the expansion side relief passage 19. A contraction side relief valve 22 that opens when the pressure in the piston side chamber 6 exceeds the pressure in the rod side chamber 5 by a predetermined amount, thereby opening the contraction side relief passage 20 such that the pressure in the piston side chamber 6 escapes into the rod side chamber 5, is provided on midway of the contraction side relief passage 20. The expansion side relief valve 21 and the contraction side relief valve 22 need not be provided. By providing the valves, it is possible to prevent the pressure in the cylinder 2 from becoming excessive, and therefore the actuator unit 1 can be protected.

The first variable relief valve 12 and a first check valve 13 are provided on midway of the first control passage 10 that communicates the rod side chamber 5 with the tank 7. The first check valve 13 is provided parallel to the first variable relief valve 12. The first control passage 10 includes a main passage 10*a*, and a branch passage 10*b* that branches from the main passage 10*a* and then converges with the main passage 10*a* again. Here, the first control passage 10 includes the main passage 10*a* and the branch passage 10*b* that branches from the main passage 10*a*, but the first control passage 10 may be constituted by two independent passages.

The first variable relief valve 12 includes a valve body 12*a* provided on midway of the main passage 10*a* of the first control passage 10, a spring 12*b* that is configured to bias the valve body 12*a* so as to block the main passage 10*a*, and a proportional solenoid 12*c* which, when energized, generates thrust against the spring 12*b*. The valve opening pressure of the first variable relief valve 12 can be adjusted by adjusting a current amount flowing to the proportional solenoid 12*c*.

The pressure in the rod side chamber 5 upstream of the first control passage 10 acts on the valve body 12*a* of the first variable relief valve 12. A resultant force of thrust generated by the pressure in the rod side chamber 5 and the thrust generated by the proportional solenoid 12*c* serves as a force for pressing the valve body 12*a* in a direction for opening the first control passage 10. When the pressure in the rod side chamber 5 exceeds the valve opening pressure of the first variable relief valve 12, the resultant force of the thrust generated by the pressure in the rod side chamber 5 and the thrust generated by the proportional solenoid 12*c* overcomes a biasing force of the spring 12*b* that biases the valve body 12*a* in the direction for blocking the first control passage 10. Accordingly, the valve body 12*a* retreats such that the first control passage 10 opens, and as a result, the working oil is allowed to move from the rod side chamber 5 toward the tank 7. Conversely, the first variable relief valve 12 does not open, and therefore the working oil is prevented from flowing from the tank 7 toward the rod side chamber 5.

In the first variable relief valve 12, the thrust generated by the proportional solenoid 12*c* can be increased by increasing the current amount supplied to the proportional solenoid 12*c*. Hence, when the current amount supplied to the proportional solenoid 12*c* is set at a maximum, the valve opening pressure of the first variable relief valve 12 reaches a minimum, and conversely, when no current is supplied to the proportional solenoid 12*c* at all, the valve opening pressure reaches a maximum.

The first check valve 13 is provided on midway of the branch passage 10*b* of the first control passage 10. The first check valve 13 allows the working oil to flow only from the tank 7 toward the rod side chamber 5, and prevents the working oil from flowing in the opposite direction.

The second variable relief valve 14 and a second check valve 15 are provided on midway of the second control passage 11 that communicates the piston side chamber 6 with the tank 7. The second check valve 15 is provided parallel to the second variable relief valve 14. The second control passage 11 includes a main passage 11*a*, and a branch passage 11*b* that branches from the main passage 11*a* and then converges with the main passage 11*a* again. Here, the second control passage 11 is constituted by the main passage 11*a* and the branch passage 11*b* that branches from the main passage 11*a*, but the second control passage 11 may be constituted by two independent passages.

The second variable relief valve 14 includes a valve body 14*a* provided on midway of the main passage 11*a* of the second control passage 11, a spring 14*b* that is configured to bias the valve body 14*a* so as to block the main passage 11*a*, and a proportional solenoid 14*c* which, when energized, generates thrust against the spring 14*b*. The valve opening pressure of the second variable relief valve 14 can be adjusted by adjusting a current amount flowing to the proportional solenoid 14*c*.

The pressure in the piston side chamber 6 upstream of the second control passage 11 acts on the valve body 14*a* of the second variable relief valve 14. A resultant force of a thrust generated by the pressure in the piston side chamber 6 and the thrust generated by the proportional solenoid 14*c* serves as a force for pressing the valve body 14*a* in a direction for opening the second control passage 11. When the pressure in the piston side chamber 6 exceeds the valve opening pressure of the second variable relief valve 14, the resultant force of the thrust generated by the pressure in the piston side chamber 6 and the thrust generated by the proportional solenoid 14*c* overcomes a biasing force of the spring 14*b* that biases the valve body 14*a* in the direction for blocking the second control passage 11. Accordingly, the valve body 14*a* retreats such that the second control passage 11 opens, and as a result, the working oil is allowed to move from the piston side chamber 6 toward the tank 7. Conversely, the second variable relief valve 14 does not open, and therefore the working oil is prevented from flowing from the tank 7 toward the piston side chamber 6.

In the second variable relief valve 14, the thrust generated by the proportional solenoid 14*c* can be increased by increasing the current amount supplied to the proportional solenoid 14*c*. Hence, when the current amount supplied to the proportional solenoid 14*c* is set at a maximum, the valve opening pressure of the second variable relief valve 14 reaches a minimum, and conversely, when no current is supplied to the proportional solenoid 14*c* at all, the valve opening pressure reaches a maximum.

The second check valve 15 is provided on midway of the branch passage 11*b* of the second control passage 11. The second check valve 15 allows the working oil to flow only from the tank 7 toward the piston side chamber 6, and prevents the working oil from flowing in the opposite direction.

The pump 8 is driven by a motor 23 to discharge the working oil drawn from the tank 7. A discharge port of the pump 8 is capable of with the rod side chamber 5 and the piston side chamber 6 via a supply passage 24. When driven by the motor 23, therefore, the pump 8 can suction the working oil from the tank 7 and supply the working oil to the rod side chamber 5 and the piston side chamber 6.

Since the pump 8 described above discharges the working oil in only one direction, an operation to switch a rotation direction thereof is not required. Hence, a problem whereby a discharge amount varies when the rotation direction is switched does not arise, and therefore an inexpensive gear pump or the like may be used as the pump 8. Further, the motor 23 also need only rotate in one direction, and therefore the motor 23 does not require a high degree of responsiveness in relation to a rotation switch. Hence, an inexpensive motor may likewise be used as the motor 23.

The supply passage 24 includes a common passage 24*a* connected to the discharge port of the pump 8, a rod side passage 24*b* that branches from the common passage 24*a* and is connected to the rod side chamber 5, and a piston side passage 24*c* that likewise branches from the common passage 24*a*, and is connected to the piston side chamber 6.

The direction control valve 9 is provided on a branch part of the supply passage 24. A check valve 25 that prevents backflow of the working oil from the rod side chamber 5 to the pump 8 is provided on midway of the rod side passage 24*b*. A check valve 26 that prevents backflow of the working oil from the piston side chamber 6 to the pump 8 is provided on midway of the piston side passage 24*c*. By providing a check valve that prevents backflow of the working oil from both the rod side chamber 5 and the piston side chamber 6 to the pump 8 on midway of the common passage 24*a*, the check valves 25, 26 need not be provided respectively on the rod side passage 24*b* and the piston side passage 24*c*.

The direction control valve 9 is a solenoid direction control valve. The direction control valve 9 includes a valve main body 90 having a first position 90*a*, in which the common passage 24*a* and the rod side passage 24*b* communicate with each other but communication between the common passage 24*a* and the piston side passage 24*c* is blocked, and a second position 90*b*, in which the common passage 24*a* and the piston side passage 24*c* communicate with each other but communication between the common passage 24*a* and the rod side passage 24*b* is blocked; a spring 91 configured to bias the valve main body 90 so as to position the valve main body 90 in the first position 90*a*; and a solenoid 92 which, when energized, switches the valve main body 90 to the second position 90*b* against a biasing force of the spring 91. The direction control valve 9 therefore takes the first position 90*a* when not energized, although the direction control valve 9 may take the second position 90*a*.

A through hole 2*a* that communicates with the interior and the exterior of the cylinder 2 is provided in a position of the cylinder 2 that opposes the piston 3 when the piston 3 is positioned in a stroke center, i.e. a neutral position relative to the cylinder 2. The through hole 2*a* communicates with the tank 7 via the center passage 16, thereby connecting the cylinder 2 to the tank 7. Hence, the interior of the cylinder 2 communicates with the tank 7 via the center passage 16 except when the piston 2 opposes the through hole 2*a* so as to block the through hole 2*a*. In the actuator unit 1, the position in which the through hole 2*a* is drilled into the cylinder 2 matches the stroke center serving as the neutral position of the piston 3, and the neutral position of the piston 3 matches the center of the cylinder 2. However, the neutral position of the piston 3 is not limited to the center of the cylinder 2, and may be set as desired. Further, the through hole 2*a* is not limited to the neutral position of the piston 3, and may be provided in another position of the cylinder 2.

An opening/closing valve 28 that opens and blocks the center passage 16 is provided on midway of the center passage 16. In this case, the opening/closing valve 28 is a solenoid opening/closing valve. The opening/closing valve 28 includes a valve main body 29 having a communication position 29*a* in which the center passage 16 is open and a blocking position 29*b* in which the center passage 16 is blocked; a spring 30 that is configured to bias the valve main body 29 so as to position the valve main body 29 in the communication position 29*a*; and a solenoid 31 which, when energized, switches the valve main body 29 to the blocking position 29*b* against a biasing force of the spring 30. The opening/closing valve 28 may be an opening/closing valve that is opened and closed by manual operations, rather than a solenoid opening/closing valve.

Next, an operation of the actuator unit 1 will be described. First, a case in which the opening/closing valve 28 blocks the center passage 16 will be described.

When the actuator unit 1 expands and contracts while the center passage 16 is blocked, pressure does not escape into the tank 7 through the center passage 16 regardless of the position of the piston 3 relative to the cylinder 2. In the actuator unit 1, the working oil discharged from the pump 8 can be supplied selectively to the rod side chamber 5 and the piston side chamber 6 in accordance with the position of the direction control valve 9. In the actuator unit 1, the pressure in the rod side chamber 5 can be adjusted by the first variable relief valve 12, and the pressure in the piston side chamber 6 can be adjusted by the second variable relief valve 14. Hence, the chamber to which the working oil discharged from the pump 8 is to be supplied can be selected by switching the position of the direction control valve 9, and the direction and magnitude of the thrust generated by the actuator unit 1 can be controlled by adjusting the respective valve opening pressures of the first variable relief valve 12 and the second variable relief valve 14 so as to adjust the differential pressure between the respective pressures in the rod side chamber 5 and the piston side chamber 6.

For example, when the actuator unit 1 is to be caused to output thrust in the expansion direction, the direction control valve 9 is caused to take the second position 90*b* such that the working oil is supplied to the piston side chamber 6 from the pump 8 while adjusting the valve opening pressure of the first variable relief valve 12 and the valve opening pressure of the second variable relief valve 14.

The piston 3 receives the pressure of the rod side chamber 5 on an annular surface thereof that faces the rod side chamber 5. The resultant force (referred to hereafter as a "rod side force") of the force obtained by multiplying the rod side pressure receiving surface area, which is the surface area of the annular surface, by the pressure in the rod side chamber 5 and the force obtained by multiplying the acting on the rod 4 from the exterior of the actuator unit 1 by the surface area of the rod 4 acts on the piston 3 in a rightward direction in FIG. 1, which is a direction for causing the actuator unit 1 to contract. Further, the piston 3 receives the pressure of the piston side chamber 6 on a surface thereof that faces the piston side chamber 6. A force (referred to hereafter as a "piston side force") obtained by multiplying the piston side pressure receiving surface area, which is the surface area of the surface facing the piston side chamber 6, by the pressure in the piston side chamber 6 acts on the piston 3 in a leftward direction in FIG. 1, which is a direction for causing the actuator unit 1 to expand. The first variable relief valve 12 opens upon reaching the valve opening pressure such that the pressure in the rod side chamber 5 escapes into the tank 7, and therefore the pressure in the rod side chamber 5 can be made equal to the valve opening pressure of the first variable relief valve 12. The second variable relief valve 14 opens upon reaching the valve opening pressure such that the pressure in the piston side chamber 6 escapes into the tank 7, and therefore the pressure in the piston side chamber 6 can be made equal to the valve opening pressure of the second variable relief valve 14. Hence, by supplying the working oil discharged from the pump 8 to the piston side chamber 6 and adjusting the respective pressures of the rod side chamber 5 and the piston side chamber 6 such that the piston side force exceeds the rod side force and a force obtained by subtracting the rod side force from the piston side force has a desired magnitude, the actuator unit 1 can be caused to generate desired thrust in the expansion direction.

When the actuator unit 1 is to be caused to generate thrust in the contraction direction, the direction control valve 9 is set in the first position 90*a* such that the working oil is supplied to the rod side chamber 5 from the pump 8. The respective pressures of the rod side chamber 5 and the piston side chamber 6 are then adjusted by adjusting the valve opening pressure of the first variable relief valve 12 and the valve opening pressure of the second variable relief valve 14 such that the rod side force exceeds the piston side force and a force obtained by subtracting the piston side force from the rod side force has a desired magnitude. By doing so, the actuator unit 1 can be caused to generate desired thrust in the contraction direction.

To control the thrust of the actuator unit 1, a relationship between the current amounts applied to the respective proportional solenoids 12*c*, 14*c* of the first variable relief valve 12 and the second variable relief valve 14 and the respective valve opening pressures thereof should be learned, and in so doing, open loop control can be performed. Alternatively, feedback control may be performed using a current loop by sensing energization amounts applied to the proportional solenoids 12*c*, 14*c*. Feedback control may also be performed by sensing the respective pressures in the rod side chamber 5 and the piston side chamber 6. By minimizing the valve opening pressure of the first variable relief valve 12 when the actuator unit 1 is caused to expand and minimizing the valve opening pressure of the second variable relief valve 14 when the actuator unit 1 is caused to contract, an energy consumption of the motor 23 can be minimized.

Even in a case where the actuator unit 1 receives an external force so as to contract but desired thrust is to be obtained in the expansion direction against this contraction, the desired thrust can be obtained by adjusting the respective valve opening pressures of the first variable relief valve 12 and the second variable relief valve 14, similarly to a case in which expansion direction thrust is obtained while the actuator unit 1 expands. This applies likewise to a case in which the actuator unit 1 receives an external force so as to expand but desired thrust is to be obtained in the contraction direction against the expansion. When the actuator unit 1 expands or contracts upon reception of an external force, thrust greater than the external force is not generated thereby, and therefore the actuator unit 1 is caused to function as a damper. The actuator unit 1 includes the first check valve 13 and the second check valve 15 so that a supply of working oil from the tank 7 can be received in the chamber, from among the rod side chamber 5 and the piston side chamber 6, that expands when the actuator unit 1 is caused to expand or contract by the external force. Hence, the desired thrust can also be obtained by controlling the respective valve opening pressures of the first variable relief valve 12 and the second variable relief valve 14 after blocking the supply of working oil from the pump 8. Furthermore, by providing the check valves 25, 26 on midway of the supply passage 24, the working oil is prevented from flowing back to the pump 8 from the cylinder 2 when the actuator unit 1 is caused to expand and contract by an external force. Therefore, even in a situation where the thrust generated in accordance with a torque of the motor 23 is insufficient, the actuator unit 1 can be caused to function as a damper by adjusting the respective valve opening pressures of the first variable relief valve 12 and the second variable relief valve 14, and as a result, the actuator unit 1 can generate a resistance force (a damping force) against the external force that is equal to or greater than the thrust generated in accordance with the torque of the motor 23.

Next, a case in which the center passage 16 is opened by the opening/closing valve 28 will be described. First, a condition obtained in this case by driving the pump 8 and setting the direction control valve 9 in the second position 90*b* so that working oil is supplied to the piston side chamber 6 will be described. When, in this condition, the piston 3 moves leftward in FIG. 1, i.e. in the expansion direction, beyond the through hole 2*a* with the center passage 16, the pressure in the rod side chamber 5 is adjusted to the valve opening pressure of the first variable relief valve 12. The piston side chamber 6, meanwhile, communicates with the tank 7 via both the center passage 16 and the second variable relief valve 14, and therefore the pressure in the piston side chamber 6 is maintained at the tank pressure.

In this case, the actuator unit 1 generates thrust in a direction for pushing the piston 3 rightward in FIG. 1, i.e. in the contraction direction, in accordance with the pressure in the rod side chamber 5. On the other hand, the pressure in the piston side chamber 6 equals the tank pressure, and therefore the piston 3 cannot be pushed leftward in FIG. 1, i.e. in the expansion direction. In other words, the actuator unit 1 cannot generate thrust in the expansion direction. This condition is maintained until the piston 3 opposes the through hole 2*a* so as to block the center passage 16. Hence, the actuator unit 1 does not generate thrust in the expansion direction until the piston 3 blocks the center passage 16 by stroking in the direction for causing the piston side chamber 6 to contract from a condition in which the piston 3 is leftward of the through hole 2*a* in the center passage 16 in FIG. 1.

Next, a condition in which the pump 8 is driven and the direction control valve 9 is caused to take the first position 90*a* such that working oil is supplied to the rod side chamber 5 from the pump 8 will be described. When, in this condition, the piston 3 moves rightward in FIG. 1, i.e. in the contraction direction, beyond the through hole 2*a* with the center passage 16, the pressure in the piston side chamber 6 is adjusted to the valve opening pressure of the second variable relief valve 14. The rod side chamber 5, meanwhile, communicates with the tank 7 via both the center passage 16 and the first variable relief valve 12, and therefore the pressure in the rod side chamber 5 is maintained at the tank pressure.

In this case, therefore, the actuator unit 1 generates thrust in a direction for pushing the piston 3 leftward in FIG. 1, i.e. in the expansion direction, in accordance with the pressure in the piston side chamber 6. On the other hand, the pressure in the rod side chamber 5 equals the tank pressure, and therefore the piston 3 cannot be pushed rightward in FIG. 1. In other words, the actuator unit 1 cannot generate thrust in the contraction direction. This condition is maintained until the piston 3 opposes the through hole 2*a* so as to block the center passage 16. Hence, the actuator unit 1 does not generate thrust in the contraction direction until the piston 3 blocks the center passage 16 by stroking in the direction for causing the rod side chamber 5 to contract from a condition in which the piston 3 is rightward of the through hole 2*a* in the center passage 16 in FIG. 1.

Next, a condition in which the pump 8 is not driven such that the actuator unit 1 is caused to function as a damper, and the center passage 16 is opened by the opening/closing valve 28, will be described. In this case, when the piston 3 is leftward, i.e. on the expansion direction side, of the through hole 2*a* with the center passage 16 in FIG. 1 such that the actuator unit 1 performs an expansion operation, the pressure in the rod side chamber 5 is adjusted to the valve opening pressure of the first variable relief valve 12, while the piston side chamber 6 is maintained at the tank pressure via the center passage 16. Accordingly, the actuator unit 1 can generate thrust in the contraction direction against the expansion operation. On the other hand, when the actuator unit 1 performs a contraction operation, the first check valve 13 opens such that the pressure in the rod side chamber 5 also reaches the tank pressure. As a result, the actuator unit 1 does not generate thrust in the expansion direction. This condition is maintained until the piston 3 opposes the through hole 2*a* so as to block the center passage 16. Hence, the actuator unit 1 does not generate thrust in the expansion direction until the piston 3 blocks the center passage 16 by stroking in the direction for causing the piston side chamber 6 to contract from a condition in which the piston 3 is leftward of the through hole 2*a* in the center passage 16 in FIG. 1. Conversely, when the piston 3 is rightward of the through hole 2*a* with the center passage 16 in FIG. 1 such that the actuator unit 1 performs a contraction operation, the pressure in the piston side chamber 6 can be adjusted to the valve opening pressure of the second variable relief valve 14, while the rod side chamber 5 is maintained at the tank pressure via the center passage 16. Accordingly, the actuator unit 1 can generate thrust in the expansion direction against the contraction operation. On the other hand, when the actuator unit 1 performs an expansion operation, the second check valve 15 opens such that the pressure in the piston side chamber 6 also reaches the tank pressure. As a result, the actuator unit 1 does not generate thrust in the contraction direction. This condition is maintained until the piston 3 opposes the through hole 2*a* so as to block the center passage 16. Hence, the actuator unit 1 does not generate thrust in the contraction direction until the piston 3 blocks the center passage 16 by stroking in the direction for causing the rod side chamber 5 to contract from a condition in which the piston 3 is rightward of the through hole 2*a* in the center passage 16 in FIG. 1.

In other words, in a case where the center passage 16 is opened by the opening/closing valve 28, the actuator unit 1 can generate thrust only in a direction for returning the piston 3 to the center of the cylinder 2 while functioning as an actuator. While functioning as a damper, the actuator unit 1 generates thrust against the stroke of the piston 3 only in a case where the piston 3 strokes in a direction away from the center of the cylinder 2. Hence, regardless of whether the actuator unit 1 functions as an actuator or a damper, thrust is generated thereby only in a direction for returning the piston 3 to the neutral position side both when the piston 3 is leftward and rightward of the neutral position in FIG. 1.

Figure 2:
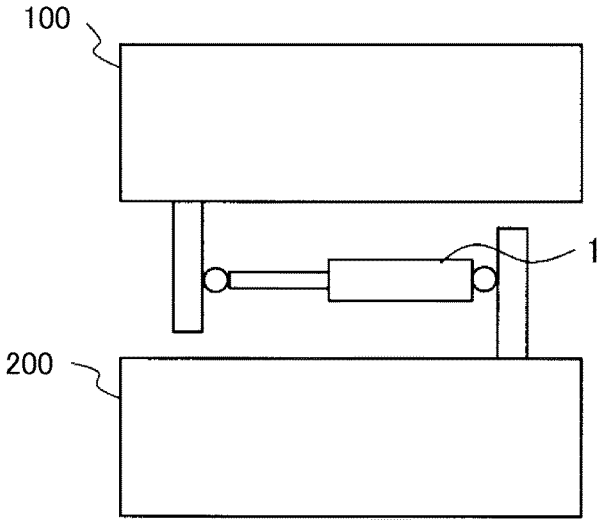
FIG. 2 is a view showing a condition in which the actuator unit according to this embodiment of the present invention is interposed between a vibration damping subject and a vibration input side unit.
Figure 3:
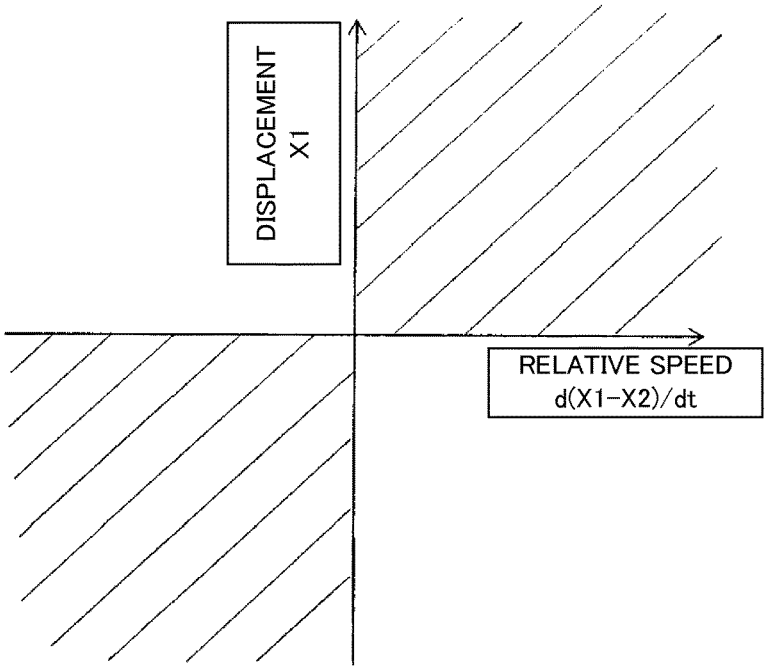
FIG. 3 is a view illustrating respective conditions in which the actuator unit according to this embodiment of the present invention does and does not generate thrust.
Figure 4:
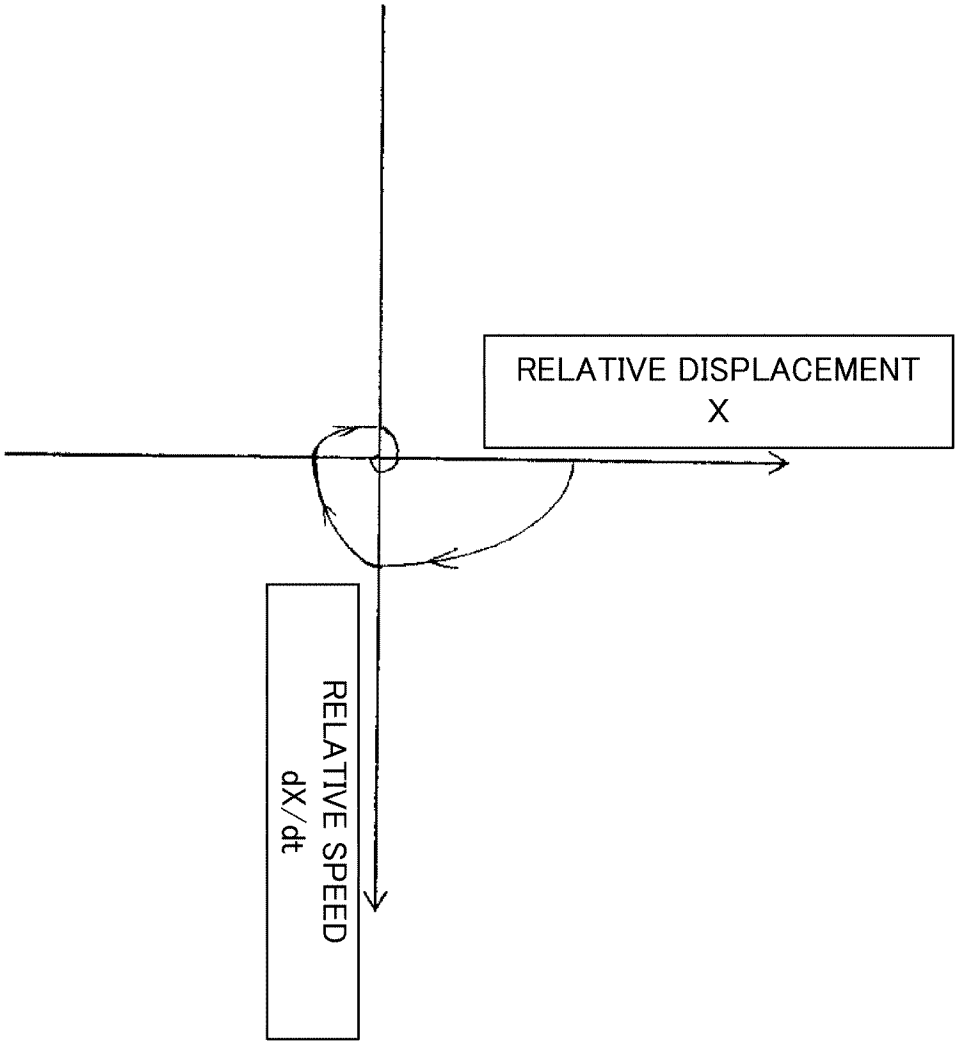
FIG. 4 is a view showing respective courses of a relative displacement and a relative speed between the vibration damping subject and the vibration input side unit to which the actuator unit according to this embodiment of the present invention is applied.

Here, as shown in FIG. 2, a model in which the actuator unit 1 is interposed between a vehicle body serving as a vibration damping subject 100 and a truck serving as a vibration input side unit 200 will be considered. In FIG. 2, left-right direction displacement of the vibration damping subject 100 is set as X1, and left-right direction displacement of the vibration input side unit 200 is set as X2. A relative speed between the vibration damping subject 100 and the vibration input side unit 200 is set as d (X1−X2)/dt. FIG. 3 is a view on which rightward displacement in FIG. 2 is taken as a positive value, the displacement X1 is shown on the ordinate, and the relative speed d (X1−X2)/dt is shown on the abscissa. As shown in FIG. 3, the actuator unit 1 generates damping force in a first quadrant and a third quadrant, which are shaded in the figure. This is equivalent to an increase in an apparent rigidity of the actuator unit 1 when the actuator unit 1 generates thrust and a reduction in the apparent rigidity when the actuator unit 1 does not generate thrust. FIG. 4 is a view on which relative displacement occurring between the vibration input side unit 200 and the vibration damping subject 100 when the vibration damping subject 100 displaces relative to the vibration input side unit 200 is set as X, and the relative speed is set as dX/dt. As shown in FIG. 4, on a phase plane of the relative displacement X and the relative speed dX/dt, a vibration trajectory is absorbed into the origin, thereby becoming asymptotically stable, and as a result, the vibration does not diverge.

In the actuator unit 1 according to this embodiment, as described above, the center passage 16 is provided, thrust to assist the separating of the piston 3 from the neutral position is not generated. This makes it possible to absorb vibration easily. As a result, vibration of the vibration damping subject 100 can be suppressed with stability. When the actuator unit is used between a vehicle body and a truck of a railway vehicle, for example, and the railway vehicle travels in a curved section, steady acceleration acts on the vehicle body, and therefore the thrust output by the actuator unit may become extremely large due to effects from noise and drift input into an acceleration sensor. In such cases, with the actuator unit 1, thrust for assisting the piston 3 in separating from the neutral position is not generated when the piston 3 passes the neutral position. In other words, a situation in which the vehicle body passes the neutral position such that vibration is applied thereto does not occur, and therefore vibration is absorbed easily, leading to an improvement in passenger comfort in the railway vehicle.

In the actuator unit 1 according to this embodiment, there is no need to control the first variable relief valve 12 and the second variable relief valve 14 in conjunction with the stroke of the actuator unit 1 for realizing the operation described above. Accordingly, a stroke sensor is also unnecessary, and therefore vibration suppression can be achieved without relying on a sensor output that includes errors. Hence, vibration suppression with highly robustness can be realized.

Further, in the actuator unit 1 according to this embodiment, the working oil discharged from the pump 8 can be supplied selectively to the rod side chamber 5 and the piston side chamber 6 by the direction control valve 9. Hence, there is no need to provide two pumps, i.e. a pump to supply working oil to the rod side chamber 5 and a pump to supply working oil to the piston side chamber 6, and therefore an increase in the size of the actuator unit 1 can be suppressed while the cost thereof can be reduced.

Furthermore, in this embodiment, the opening/closing valve 28 is provided, and therefore the center passage 16 can be switched between a communicated condition and a blocked condition. By blocking the center passage 16, the actuator unit 1 can be caused to function as a typical actuator that is capable of generating thrust in both directions over the entire stroke, leading to an increase in versatility. When necessary, the center passage 16 may be opened such that stable vibration suppression is realized. For example, vibration may be suppressed by opening the center passage 16 when low frequency vibration or low frequency, high wave height vibration is input, and in so doing, there is no need to switch a control mode in order to suppress vibration when the center passage 16 is opened or closed. In other words, when vibration suppression is underway on the vibration damping subject 100 in a certain control mode such as skyhook control or H-infinity control, there is no need to modify the control mode after opening or closing the center passage 16, and therefore the need for complicated control is eliminated.

Further, the opening/closing valve 28 is set in the communication position 29*a* when not energized, and therefore stable vibration suppression can be performed during a failure by opening the center passage 16. The opening/closing valve 28 may be set to take the blocking position 29*b* when power cannot be supplied thereto. When the opening/closing valve 28 takes the communication position 29*a*, resistance may be applied to the flow of working oil passing through.

In the actuator unit 1, the opening position of the center passage 16 is in the center of the cylinder 2 in a position aligning with the stroke center of the piston 3. Hence, there is no bias in either direction in a stroke range in which damping force is not generated when the piston 3 is returned to the stroke center, and therefore the entire stroke length of the actuator unit 1 can be used effectively.

In the above embodiment, the vibration damping subject 100 and the vibration input side unit 200 were described as a vehicle body and a truck of a railway vehicle. However, the actuator unit 1 is not limited to be used in a railway vehicle, and may be used in other applications for suppressing vibration, such as between a building and a foundation or the like.

Embodiments of this invention were described above, but the above embodiments are merely examples of applications of this invention, and the technical scope of this invention is not limited to the specific constitutions of the above embodiments.

This application claims priority based on Japanese Patent Application No. 2013-027243 filed with the Japan Patent Office on Feb. 15, 2013, the entire contents of which are incorporated into this specification.

The invention claimed is:

1. An actuator unit, comprising:

a cylinder;

a piston slidably inserted into the cylinder, the piston defining a rod side chamber and a piston side chamber in the cylinder;

a rod inserted into the cylinder and coupled to the piston;

a tank;

a pump;

a direction control valve configured to allow a working fluid discharged from the pump to be supplied selectively to the rod side chamber and the piston side chamber;

a first control passage that communicates the rod side chamber with the tank;

a second control passage that communicates the piston side chamber with the tank;

a first variable relief valve provided on the first control passage, the first variable relief valve being configured to have a varied valve opening pressure;

a second variable relief valve provided on the second control passage, the second variable relief valve configured to have a varied valve opening pressure; and a center passage that communicates the tank with the interior of the cylinder, wherein the first variable relief valve opens when a pressure in the rod side chamber reaches the valve opening pressure so as to allow the working fluid to flow from the rod side chamber toward the tank, the second variable relief valve opens when a pressure in the piston side chamber reaches the valve opening pressure so as to allow the working fluid to flow from the piston side chamber toward the tank, the center passage includes a through hole that communicates with the interior and an exterior of the cylinder, the piston is configured to block the through hole when the piston is opposite the through hole, the through hole opens into the cylinder in a position aligning with a stroke center of the piston, an opening/closing valve that is a solenoid valve is provided on the center passage to open and close the center passage, the opening/closing valve is configured to close the center passage when not energized, an expansion side relief passage and a contraction side relief passage each of which communicates the rod side chamber and the piston side chamber are provided in the piston, an expansion side relief valve is provided in the expansion side relief passage, the expansion side relief valve being configured to open when the pressure in the rod side chamber exceeds the pressure in the piston side chamber by a predetermined amount, and a contraction side relief valve is provided in the contraction side relief passage, the contraction side relief valve being configured to open when the pressure in the piston side chamber exceeds the pressure in the rod side chamber by a predetermined amount.

2. The actuator unit according to claim 1, further comprising:

a first check valve provided on the first control passage in parallel with the first variable relief valve, the first check valve allowing the working fluid to pass only from the tank toward the rod side chamber; and a second check valve provided on the second control passage in parallel with the second variable relief valve, the second check valve allowing the working fluid to pass only from the tank toward the piston side chamber.

3. The actuator unit according to claim 1, further comprising a supply passage having a common passage, a rod side passage, and a piston side passage, the common passage being connected to a discharge port of the pump, the rod side passage being connected to the rod side chamber, the piston side passage being connected to the piston side chamber, wherein the direction control valve includes:

a valve main body having a first position and a second position, the first position enables the common passage and the rod side passage to communicate with each other and blocks communication between the common passage and the piston side passage, the second position enables the common passage and the piston side passage to communicate with each other and blocks communication between the common passage and the rod side passage;

a spring configured to bias the valve main body so as to position the valve main body at one of the first position and the second position; and a solenoid, when energized, switching the valve main body to the other of the first position and the second position against a biasing force of the spring, and wherein the direction control valve is provided on the supply passage.

* * * * *